US006118970A

United States Patent [19]

Suzuki et al.

[11] Patent Number: 6,118,970

[45] Date of Patent: Sep. 12, 2000

[54] CLEANING ROLLER

[75] Inventors: Masayuki Suzuki; Hirokazu Ando; Takao Mizutani; Masao Isoda, all of Tokyo, Japan

[73] Assignee: Oki Data Corporation, Tokyo, Japan

[21] Appl. No.: 09/324,772

[22] Filed: Jun. 3, 1999

[30] Foreign Application Priority Data

Jun. 4, 1998 [JP] Japan ..... 10-156154

[51] Int. Cl.[7] ..... G03G 21/00

[52] U.S. Cl. ..... 399/357

[58] Field of Search ..... 399/357, 343, 399/149, 150; 15/1.51, 256.51, 256.52; 492/28, 30, 33, 48, 53, 56

[56] References Cited

U.S. PATENT DOCUMENTS

| | | | |
|---|---|---|---|
| 3,807,853 | 4/1974 | Hudson | 399/357 |
| 4,101,215 | 7/1978 | Fottner et al. | 399/357 X |
| 4,252,433 | 2/1981 | Sullivan | 399/357 |
| 4,392,742 | 7/1983 | Landa | 399/357 X |
| 4,533,235 | 8/1985 | Uchida | 399/357 |
| 4,967,231 | 10/1990 | Hosoya et al. | 399/357 X |
| 5,333,041 | 7/1994 | Ito et al. | 399/149 |
| 5,530,537 | 6/1996 | Thayer | 399/357 |

*Primary Examiner*—Sophia S. Chen
*Attorney, Agent, or Firm*—Rabin & Champagne, PC

[57] ABSTRACT

A cleaning roller is used for electrostatically attracting residual toner left on a photoconductive drum. The cleaning roller includes a shaft and a member formed on the shaft to cover the shaft. The member has contact portions that lie in a cylindrical plane and a plurality of recesses that are formed in the member and bounded by the contact portions. The contact portions are in contact with the photoconductive drum to attract residual toner left on the photoconductive drum. The recesses hold therein the residual toner attracted to the contact portions. The recesses have openings that lie in the cylindrical plane such that a ratio of the areas of the contact portions to the areas of the openings is in the range from 3:7 to 1:1. The openings of the recesses have effective diameters in the range from 50 to 150 $\mu$m if the toner particles have effective diameters in the range from 6 to 9 $\mu$m. The cleaning roller includes a metal shaft and a resilient member formed on the metal shaft to cover the metal shaft. The resilient member has an electrical resistance in the range from $5\times10^6$ Ω to $5\times10^9$ Ω.

5 Claims, 5 Drawing Sheets

FIG.5

TABLE I

| DIAMETER OF CELL | INITIAL GHOST | GHOST AFTER PRINTING 30,000 PAGES |
|---|---|---|
| 25~50 μm | A | C |
| 50~100 μm | A | A |
| 100~150 μm | A | A |
| 150~200 μm | B | B |
| 200~250 μm | C | C |

FIG.6

TABLE II

| RESISTANCE | GHOST | POOR TRANSFER DUE TO LEAKAGE |
|---|---|---|
| $5\times10^{5}\Omega$ | A | C |
| $5\times10^{6}\Omega$ | A | A |
| $5\times10^{7}\Omega$ | A | A |
| $5\times10^{8}\Omega$ | A | A |
| $5\times10^{9}\Omega$ | A | A |
| $5\times10^{10}\Omega$ | B | A |

CLEANING ROLLER

FIELD OF THE INVENTION

The present invention relates to a cleaning roller for an image forming apparatus.

DESCRIPTION OF THE RELATED ART

A conventional electrophotographic printer performs the steps of charging, exposing, developing, transferring, and fixing. A charging unit uniformly chargers a surface of a photoconductive drum. An exposing unit illuminates the charged surface of the photoconductive drum to form an electrostatic latent image on the photoconductive drum. The electrostatic latent image is developed with toner by a developing roller into a toner image. Then, a print medium passes a transfer point defined between the photoconductive drum and a transfer roller. The transfer roller receives a voltage of a polarity opposite to that of the toner images formed on the photoconductive drum. The voltage creates a potential difference in the range from several hundred to several thousand volts between the transfer roller and the photoconductive drum, thereby developing a uniform electric field between the photoconductive drum and the transfer roller. The toner image is attracted to the print medium by the Coulomb force.

Some of the toner particles fail to be transferred from the photoconductive drum to the print medium. Such residual toner particles are removed by the cleaning section and collected into the developing unit, so that the residual toner will not obstruct the subsequent exposing operation.

The cleaning unit includes a cleaning blade, cleaning roller, and other associated components. The cleaning blade is a blade formed of a material such as rubber and is pressed against the photoconductive drum to scratch the residual toner particles off the photoconductive drum after transfer operation. The cleaning roller includes a shaft and a roller formed on the shaft. The shaft receives a bias voltage of the polarity opposite to that of the residual toner. The roller is formed of a sponge-like resilient material and pressed against the photoconductive drum so that the residual toner is attracted to the roller by the Coulomb force.

The aforementioned cleaning operation using a blade is characterized in that the residual toner is scratched off the photoconductive drum while the cleaning operation using a roller is characterized in that the residual toner is first attracted from the photoconductive drum to the roller, returned to the photoconductive drum at a later timing, and finally collected by the developing roller.

The blade type cleaner requires, for example, a separate toner collecting device. Therefore, the roller type cleaner is preferred for its simple construction.

The cleaning roller is formed with a plurality of recesses, referred to as cells, in its surface. Surface areas of the cleaning roller among the cells are brought into contact with the photoconductive drum so that the residual toner on the photoconductive drum migrates to the cleaning roller. The cleaning roller holds thereon the residual toner migrated to the cleaning roller until the cleaning roller returns the residual toner to the photoconductive drum.

The aforementioned conventional cleaning roller exhibits different cleaning effects, depending on the effective diameter of the openings of the cells and electrical resistance of the roller.

If the openings of cells have smaller effective diameters, then the roller has a smaller toner-holding capacity and the cells will be clogged immediately after a cleaning operation is begun. If the openings of the cells have larger effective diameters, the roller will have less cells and smaller areas in contact with the photoconductive drum. Smaller contact areas reduce the chances of the roller surface touching the residual toner on photoconductive drum, so that some of the residual toner will fail to be attracted to the cleaning roller. Such residual toner causes a ghost image in the subsequent print result.

The voltage of the surface of the cleaning roller becomes progressively lower than that applied to the shaft of the cleaning roller as the electrical resistance of the cleaning roller increases. When a bias voltage is applied to the shaft, if the electrical resistance of the cleaning roller is too high, a large voltage drop occurs across the cleaning roller. Thus, the voltage of the surface of the cleaning roller becomes low so that the residual toner cannot be sufficiently attracted to the cleaning roller. The residual toner remaining on the photoconductive drum causes a ghost image in the subsequent print result. If the electrical resistance is too low, some of the current flowing from the photoconductive drum to the transfer roller will be bypassed through the cleaning roller, causing a poor transfer operation.

SUMMARY OF THE INVENTION

The present invention was made to solve the aforementioned drawbacks of the conventional cleaning roller.

An object of the present invention is to provide a cleaning roller which attracts residual toner particles efficiently from the photoconductive drum.

Another object of the present invention is to provide a cleaning roller for use in an electrophotographic printer, the cleaning roller preventing a ghost image from appearing on the subsequent print output of the electrophotographic printer.

A cleaning roller is used for electrostatically attracting residual toner left on a photoconductive drum. The cleaning roller comprises a shaft and a member formed on the shaft to cover the shaft. The member has contact portions that lie in a cylindrical plane and a plurality of recesses that are formed in the member and bounded by the contact portions. The contact portions are in contact with the photoconductive drum to attract residual toner left on the photoconductive drum. The recesses hold therein the residual toner attracted to the contact portions. The recesses have openings that lie in the cylindrical plane such that a ratio of the areas of the contact portions to the areas of the openings is in the range from 3:7 to 1:1.

The openings of recesses have effective diameters in the range from 50 to 150 $\mu$m if the toner particles have effective diameters in the range from 6 to 9 $\mu$m.

The cleaning roller includes a metal shaft and a resilient member formed on the metal shaft to cover the metal shaft. The resilient member has an electrical resistance in the range from $5\times10^6$ to $5\times10^9$ $\Omega$ Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5 shows Table I that lists performance for different effective diameters of the openings of the cells;

FIG. 6 shows Table II that lists performance for different electrical resistance values of the cells.

DESCRIPTION OF THE INVENTION

Figure 1:
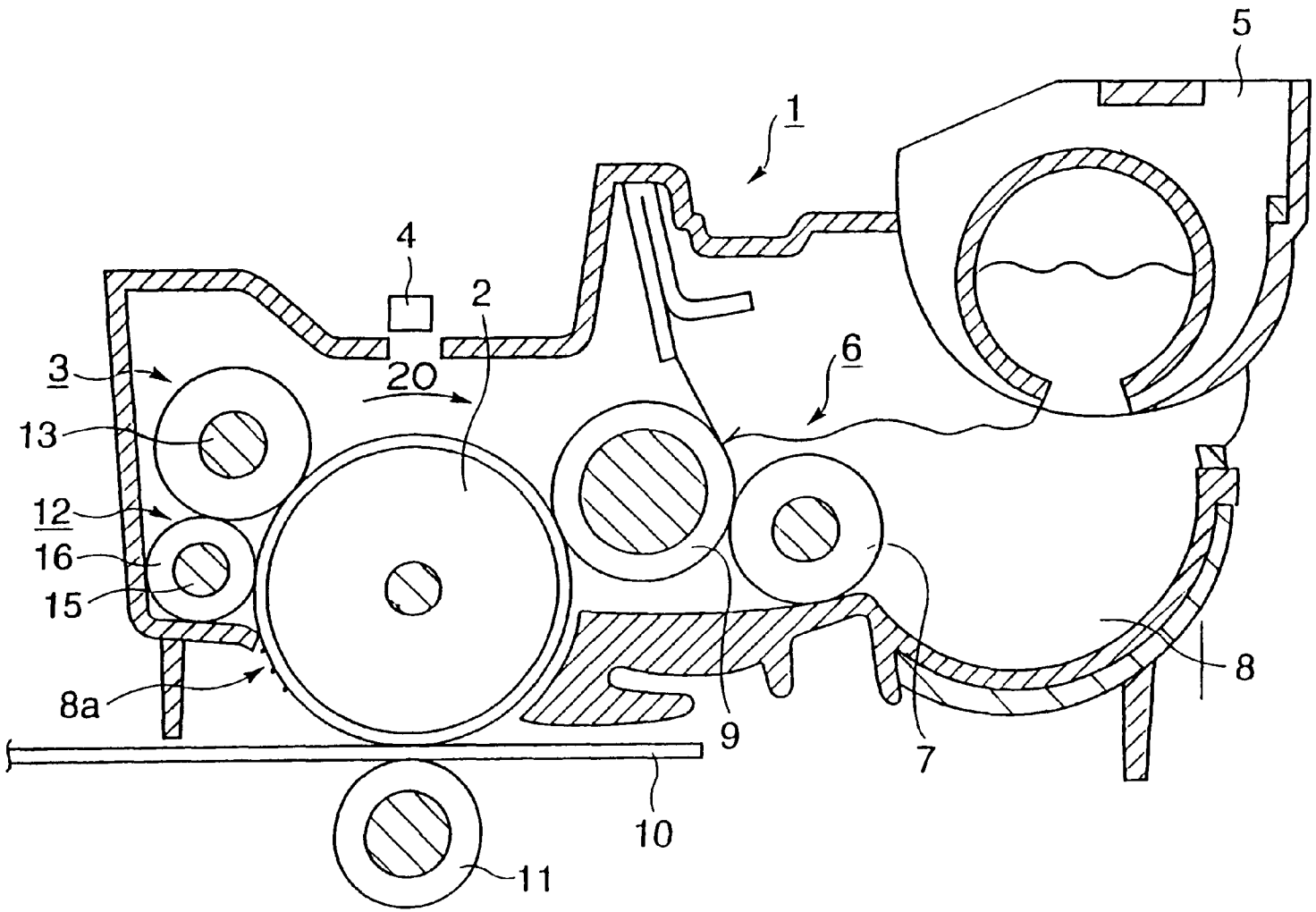
FIG. 1 is an illustrative diagram showing the construction of a print process unit according to the present invention.

Preferred embodiments of the present invention will be described in detail with reference to the accompanying drawings.

Elements of the same construction have been given the same reference numerals throughout the embodiments and the description thereof is omitted.

First Embodiment

First, the construction of a print process unit 1 incorporated in an electrophotographic printer is described. FIG. 1 is an illustrative diagram showing the construction of a print process unit according to the embodiment.

Referring to FIG. 1, the print process unit 1 incorporates a photoconductive drum 2 which bears a toner image thereon. The photoconductive drum 2 includes an electrically conductive base layer formed of, for example, aluminum, and a photoconductive layer formed on the electrically conductive base layer. The photoconductive drum 2 is driven in rotation in a direction shown by arrow 20 at a predetermined speed. A charging roller 3, an LED head 4, a developing roller 9, a transfer roller 11, and a cleaning roller 12, are disposed around the photoconductive drum 2. The charging roller 3 receives a negative voltage at the shaft 13. The negative voltage causes negative charges to be deposited on the surface of the photoconductive drum 2. The LED head 4 illuminates the charged surface of the photoconductive drum 2 to form an electrostatic latent image on the photoconductive drum 2. The developing roller 9 applies the negatively charged toner 8 to the electrostatic latent image. The effective diameter (i.e., size) of the toner particle is in the range from 6 to 9 $\mu$m. The toner 8 is delivered from a toner cartridge 5 through a toner-accommodating space 6 and agitator, not shown, and sponge roller 7 to the developing roller 9. When paper 10 passes between the photoconductive drum 2 and the transfer roller 11, the transfer roller 11 transfers the electrostatic latent image on the photoconductive drum 2 to paper 10. The cleaning roller 12 receives a bias voltage of +450 V which is of an opposite polarity to the residual toner 8. The cleaning roller 12 attracts the residual toner 8*a* remaining on the photoconductive drum 2 by the Coulomb force and neutralizes the surface of the photoconductive drum 2. The residual toner 8*a* is first attracted to the cleaning roller 12 and then again deposited on the photoconductive drum 2 at a later timing. Then, the residual toner 8*a* is finally collected from the photoconductive drum 2 by the developing roller 9.

A fixing unit, not shown, is disposed downstream of the print process unit 1 with respect to the direction of travel of the paper 10. The fixing unit incorporates a heat roller that serves to fuse the toner deposited on the paper 10.

The aforementioned sponge roller 7 and developing roller 9 form a developing unit.

Figure 2:
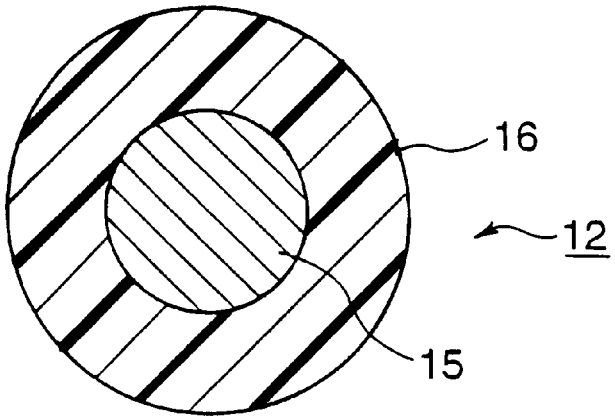
FIG. 2 is a cross-sectional view of a cleaning roller of the invention.

FIG. 2 is a cross-sectional view of the cleaning roller 12. Referring to FIG. 2, the cleaning roller 12 includes a metal shaft 15 and a resilient member 16. The resilient member 16 is an electrically semiconductive sponge-like resilient body formed on the metal shaft 15.

Figure 3:
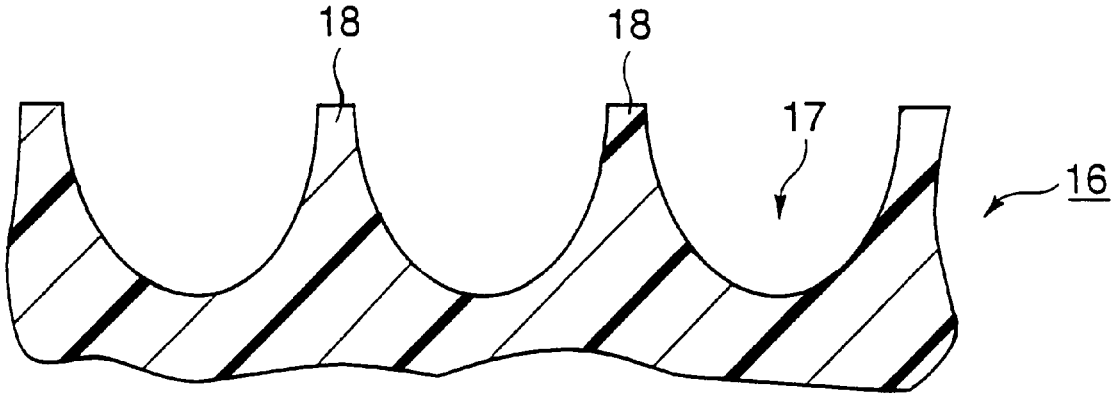
FIG. 3 is a fragmentary enlarged cross-sectional view of the cleaning roller of FIG. 2, showing the surface of the cleaning roller.

FIG. 3 is a fragmentary enlarged cross-sectional view of the cleaning roller 12, showing the cells formed in the resilient member 16.

Figure 4:
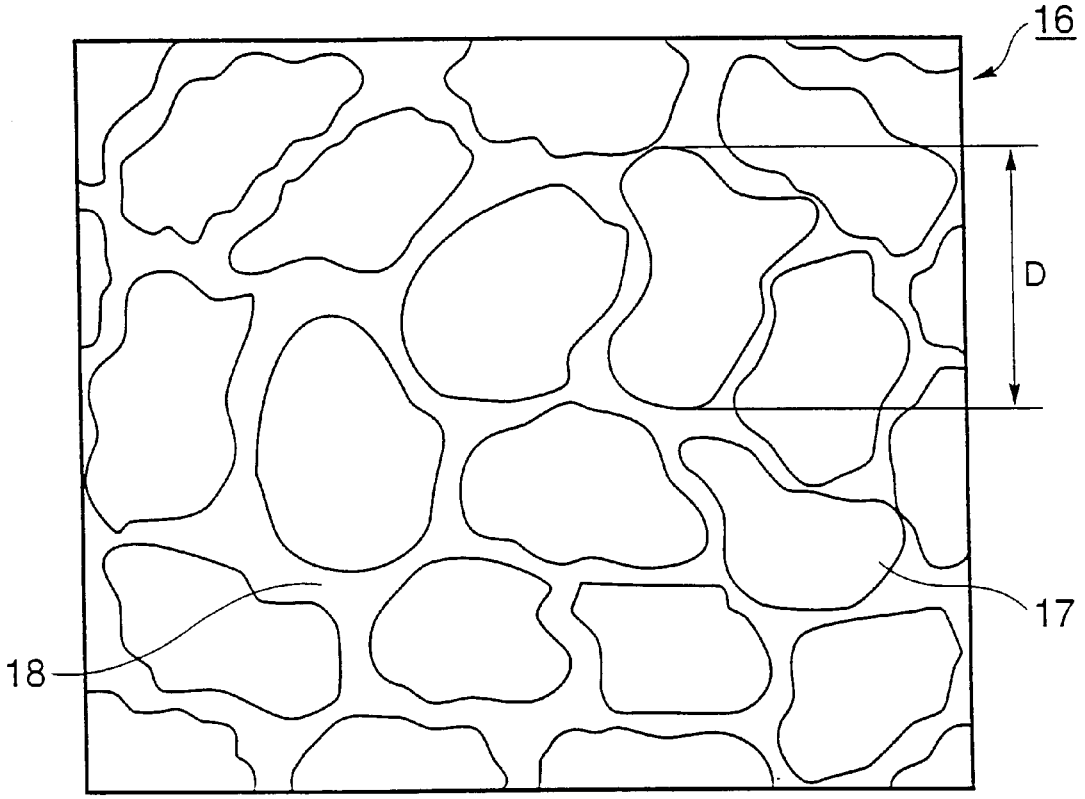
FIG. 4 is a fragmentary enlarged view of the cleaning roller of the invention, showing an area of the surface of the cleaning roller.

FIG. 4 is a fragmentary enlarged view of the resilient member 16 according to an embodiment, showing an area of the surface of the resilient member 16.

As shown in FIGS. 3 and 4, the surface of the resilient member 16 lies in a cylindrical plane and comprises a plurality of recesses (i.e., cells) 17 separated by contact areas 18. The cells 17 are formed substantially uniformly in the surface of the resilient member 16. The recesses or cells 17 have openings that lie in the cylindrical plane. The contact areas 18 lie in the cylindrical plane. The contact areas 18 are about 30–50% of the area of the cylindrical plane while openings of the cells 17 represent about 50–70% of the area of the cylindrical plane. That is, the ratio of areas of the contact portions to areas of the openings of the cells ranges from 3:7 to 1:1.

The contact areas 18 among the cells 17 contact the photoconductive drum 2 to electrostatically attract the residual toner 8*a* that still remains on the surface of the photoconductive drum 2 after transferring. The residual toner 8*a* migrates from the photoconductive drum 2 to the resilient member 16. Then, the residual toner 8*a* remains on the resilient member 16 until it is returned at a later timing from the resilient member 16 to the photoconductive drum 2.

The resilient member 16 is formed of foamed silicone or foamed polyurethane, thereby reducing load exerted thereon during rotation, and jitter (i.e., fluctuations in the print density resulting from unstable rotational speeds of the gears that drive the rollers in rotation). The photoconductive drum 2 and the cleaning roller 12 are rotated such that the ratio of the circumferential speed of the photoconductive drum 2 to that of the cleaning roller 12 is a predetermined value.

The cleaning performance of the cleaning roller 12 varies depending on the effective diameter D of the openings of the cells 17 and the electrical resistance of the resilient member 16 of FIG. 4.

FIG. 5 shows Table I that lists performance for different effective diameters of the openings of the cells.

FIG. 6 shows Table II that lists performance for different electrical resistance values of the cells.

The data in Table I assume that electrical resistance of the resilient member 16 is about $1\times10^8$ Ω.

In Table II, the effective diameter D of the opening of the cell 17 is about 100 $\mu$m. Referring to Tables I and II, "A" indicates that no ghost is observed in the print result. "B" indicates that a ghost is not observed in the print output when normal patterns (i.e., images that can be transferred without difficulty) are printed, but may appear in the print output when special patterns (e.g., bold characters that are difficult to be transferred) are printed. "C" indicates that a ghost is observed in the print result when the normal patterns are printed and when the special patterns are printed.

Some of the residual toner 8*a* fails to be attracted to the cleaning roller 12, rotates back to the transfer point as the photoconductive drum continues to rotate, and is printed together with a subsequent toner image on the paper 10. An image formed in this manner is a kind of ghost.

Figure 7:
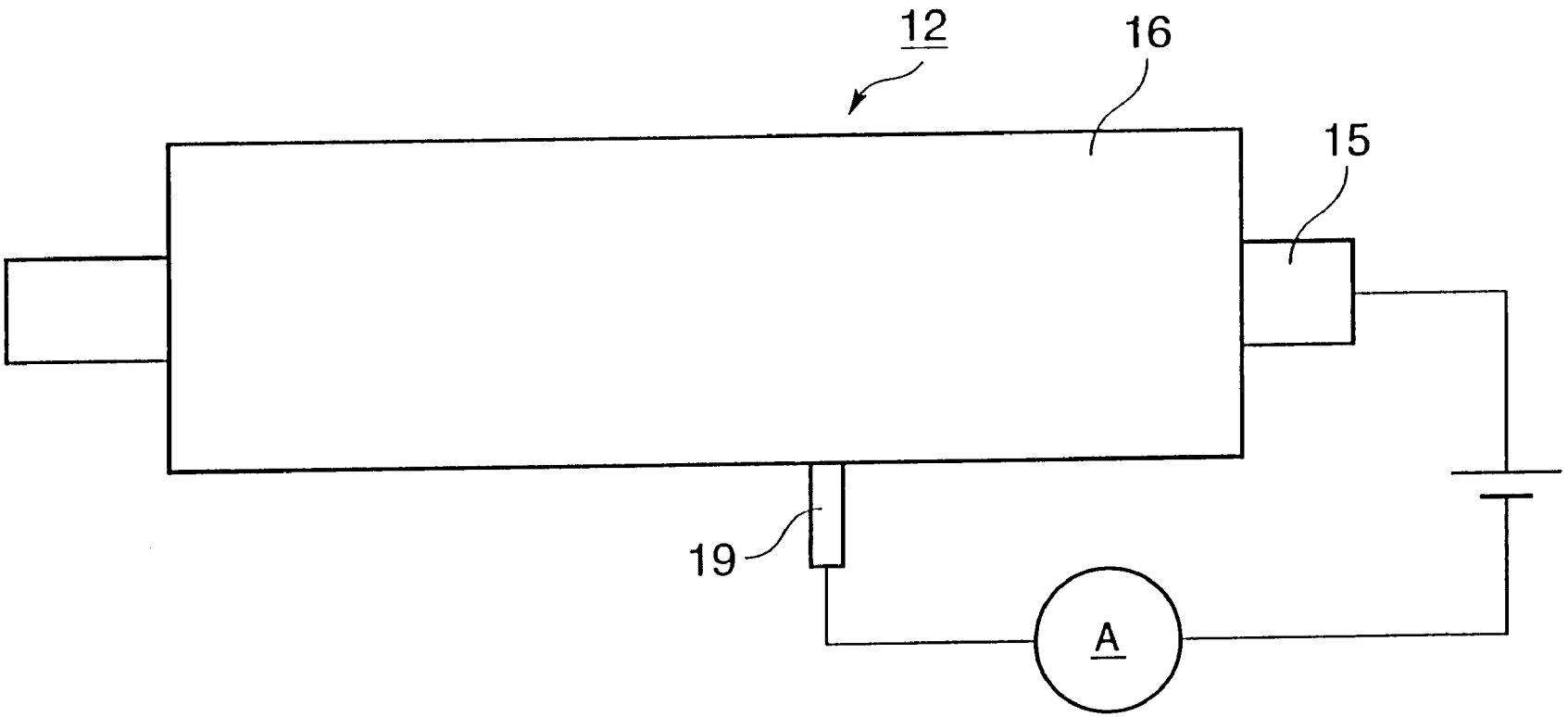
FIG. 7 is an illustrative diagram showing a set-up for testing the cleaning roller of the invention.

FIG. 7 is an illustrative diagram showing a set-up for testing the cleaning roller 12.

The electrical resistance of the resilient member 16 is measured as follows:

A voltage of +400 V is applied to the shaft 15. A ball bearing 19 having a 8 mm-diameter and a 2 mm-width is pressed against the resilient member 16 with a force of 10 gf. The resilient member 16 is rotated at a speed of 63 rpm. Then, a current through the resilient member 16 is measured.

If the effective diameter D of the opening of the cell 17 is smaller than 50 $\mu$m, the resilient member 16 cannot hold a large amount of the residual toner 8*a* since the capacity for holding residual toner 8*a* is not large. Therefore, the cells 17 become clogged shortly after the cleaning is started. If the effective diameter D of the opening of the cell 17 is larger than 150 $\mu$m, areas 18 of the surface among the cells 17 are smaller. Smaller contact areas reduce the chances of the roller surface touching the residual toner 8*a* remaining on photoconductive drum 2, so that some of the residual toner 8*a* fails to be attracted to the cleaning roller 12. Such residual toner 8*a* causes a ghost image in the subsequent print result.

If the electrical resistance is decreased to $5\times10^5$ Ω, a large amount of current flowing from the photoconductive drum 2 to the transfer roller 11 is bypassed through the cleaning roller 12, resulting in poor transfer operation. As the electrical resistance of the resilient member 16 increases, the voltage on the surface of the resilient member 16 becomes progressively lower than that applied to the shaft 15. Thus, if the electrical resistance is increased to $5\times10^{10}$ Ω, the voltage on the surface of the resilient member 16 decreases so that some of the residual toner 8*a* cannot be attracted to the cleaning roller 12, resulting in a ghost image on the next page of the paper 10.

Therefore, the resistance of the resilient member 16 is selected to be in the range from $5\times10^6$ Ω to $5\times10^9$ Ω. In the present embodiment, for the resilient member 16 having a contact area 18 which represents 30–50% of the projected area thereof, when the effective diameter of the toner 8 is in the range from 6 to 9 $\mu$m, the effective diameter of the opening of the cell 17 of the resilient member 16 is selected to be in the range from 50 to 150 $\mu$m such that the resilient member 16 has a sufficient surface area in contact with the photoconductive drum 2. Thus, the residual toner 8*a* on the photoconductive drum 2 is almost completely attracted to the resilient member 16. The effective diameter of the openings of the cells 17 is selected to be larger than 50 $\mu$m for sufficient area of cells 17, so that the resilient member 16 maintains the ability to hold the residual toner 8*a* until the end of the lifetime of the resilient member 16. Thus, the cleaning roller 12 maintains the ability to clean the photoconductive drum 2 until the resilient member 16 reaches the end of its lifetime.

Selecting the electrical resistance in the range from $5\times10^6$ to $5\times10^9$ Ω allows the residual toner 8*a* to be completely removed from the photoconductive drum 2 without affecting the other print processes such as transferring.

While the embodiment has been described with respect to a case where both the effective diameter of the opening of the cell 17 and the electrical resistance of the resilient member 16 are specified, either the effective diameter of the opening of the cell 17 or the electrical resistance of the resilient member 16 may be specified if specifying only one of the two factors allows the residual toner 8*a* to be attracted from the photoconductive drum 2 without adverse effects on the printing process.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A cleaning roller for electrostatically attracting residual toner particles on a photoconductive drum, the cleaning roller comprising:

a shaft; and a member formed on said shaft to cover said shaft, said member having contact portions that lie in a cylindrical plane and a plurality of recesses that are formed in said member and bounded by the contact portions, the contact portions being in contact with the photoconductive drum to attract residual toner particles left on the photoconductive drum, the recesses holding therein the residual toner particles attracted to the contact portions, the recesses having openings that lie in the cylindrical plane, wherein the openings of the recesses have effective diameters in the range from 50 to 150 $\mu$m if the toner particles have effective diameters in the range from 6 to 9 $\mu$m.

2. The cleaning roller according to claim 1, wherein said shaft is a metal shaft and said member is a resilient member having an electrical resistance in the range from $5\times10^6$ to $5\times10^9$ Ω.

3. A cleaning roller for electrostatically attracting residual toner on a photoconductive drum, the cleaning roller comprising:

a metal shaft receiving a voltage opposite in polarity to a polarity of toner to be removed from a photoconductive drum; and a resilient member formed on said metal shaft to cover the metal shaft, said resilient member having an electrical resistance in the range from $5\times10^6$ to $5\times10^9$ Ω;

wherein said resilient member has contact portions that lie in a cylindrical plane and a plurality of recesses that are formed in said resilient member and bounded by the contact portions, the recesses having openings that lie in the cylindrical plane;

wherein the contact portions are in contact with the photoconductive drum to attract residual toner left on the photoconductive drum into the recesses; and wherein the openings of the recesses have effective diameters in the range from 50 to 150 $\mu$m if the toner has effective diameters in the range from 6 to 9 $\mu$m.

4. A cleaning roller for electrostatically attracting residual toner on a photoconductive drum, the cleaning roller comprising:

a metal shaft; and a resilient member formed on said metal shaft to cover said metal shaft, said resilient member having an electrical resistance in the range from $5\times10^6$ to $5\times10^9$ Ω, said resilient member having contact portions that lie in a cylindrical plane and a plurality of recesses that are formed in said resilient member and bounded by the contact portions, the recesses having openings in the cylindrical plane which have effective diameters in the range from 50 to 150 $\mu$m if the toner particles have effective diameters in the range from 6 to 9 $\mu$m, a ratio of areas of the contact portions to areas of the openings being in the range from 3:7 to 1:1, wherein the contact portions are in contact with the photoconductive drum to attract the residual toner left on the photoconductive drum into the recesses.

5. A cleaning roller for cleaning a photoconductive drum, comprising:

a cylindrical member having a plurality of recesses formed therein, and a plurality of openings formed in a surface thereof, each opening being in communication with a respective recess, the recesses being for holding therein toner particles, the openings having effective diameters in the range from 50 to 150 $\mu$m if the toner particles have effective diameters in the range from 6 to 9 $\mu$m.

* * * * *